United States Patent [19]

Carlsson et al.

[11] Patent Number: 4,944,132

[45] Date of Patent: Jul. 31, 1990

[54] APPARATUS FOR THE STERILE PACKAGING OF CONTENTS

[75] Inventors: Lars C. Carlsson, Blentarp; Sven O. S. Stark, Ystad; Ulf Bengtsson, Dalby, all of Sweden

[73] Assignee: AB Tetra Pak, Lund, Sweden

[21] Appl. No.: 321,980

[22] Filed: Mar. 10, 1989

[30] Foreign Application Priority Data

Mar. 11, 1988 [DE] Fed. Rep. of Germany ..... 3808058

[51] Int. Cl.[5] ..... B65B 55/02; A61L 2/00

[52] U.S. Cl. ..... 53/167; 53/282; 422/24; 422/297; 422/304

[58] Field of Search ..... 53/90, 141, 167, 426, 53/110, 282, 425, 510; 422/22, 24, 297, 300, 304

[56] References Cited

U.S. PATENT DOCUMENTS

| | | | |
|---|---|---|---|
| 2,602,751 | 7/1952 | Robinson | 99/221 |
| 3,911,640 | 10/1975 | Rausing | 53/426 |
| 4,014,158 | 3/1977 | Rausing | 53/167 |
| 4,035,981 | 7/1977 | Braun et al. | 53/426 |
| 4,045,945 | 9/1977 | Möller et al. | 53/167 |
| 4,056,921 | 11/1977 | Gilliand et al. | 53/167 |
| 4,072,553 | 2/1978 | Braker et al. | 53/557 X |
| 4,175,140 | 11/1979 | Bachmann et al. | 53/167 X |
| 4,296,068 | 10/1981 | Hoshino | 53/167 X |
| 4,342,726 | 8/1982 | Savi | 422/304 X |
| 4,566,251 | 1/1986 | Spisak et al. | 53/167 |
| 4,590,734 | 5/1986 | Ueda | 53/52 |
| 4,622,800 | 11/1986 | Turtschan | 53/167 X |

FOREIGN PATENT DOCUMENTS

| | | | |
|---|---|---|---|
| 0013132 | 7/1980 | European Pat. Off. | 53/426 |
| 2439900 | 1/1975 | Fed. Rep. of Germany . | |
| 1525484 | 9/1978 | United Kingdom . | |
| 2089191 | 6/1982 | United Kingdom . | |

*Primary Examiner*—Robert L. Spruill
*Assistant Examiner*—Beth Bianca
*Attorney, Agent, or Firm*—Howard M. Ellis; Michael L. Dunn

[57] ABSTRACT

The invention describes an apparatus for the sterile packaging of flowable substances, comprising a conveyer belt (4), from one end of which open packages (5) can be passed by an intermediate conveyer means (21–23) through a sterilizing chamber (7) and to a second conveyer belt (13) disposed in a sterile chamber (15) enclosed in a housing (14), filling means (17) and sealing means (18) being disposed in this sterile chamber (15) while an outlet sluice (24) is disposed in a wall of the housing. In order to simplify and so further improve such an apparatus that a more effective sterilization process is achieved, it is according to the invention envisaged to construct the sterilizing chamber (15) as an inlet sluice (8).

7 Claims, 4 Drawing Sheets

APPARATUS FOR THE STERILE PACKAGING OF CONTENTS

Figure 1:
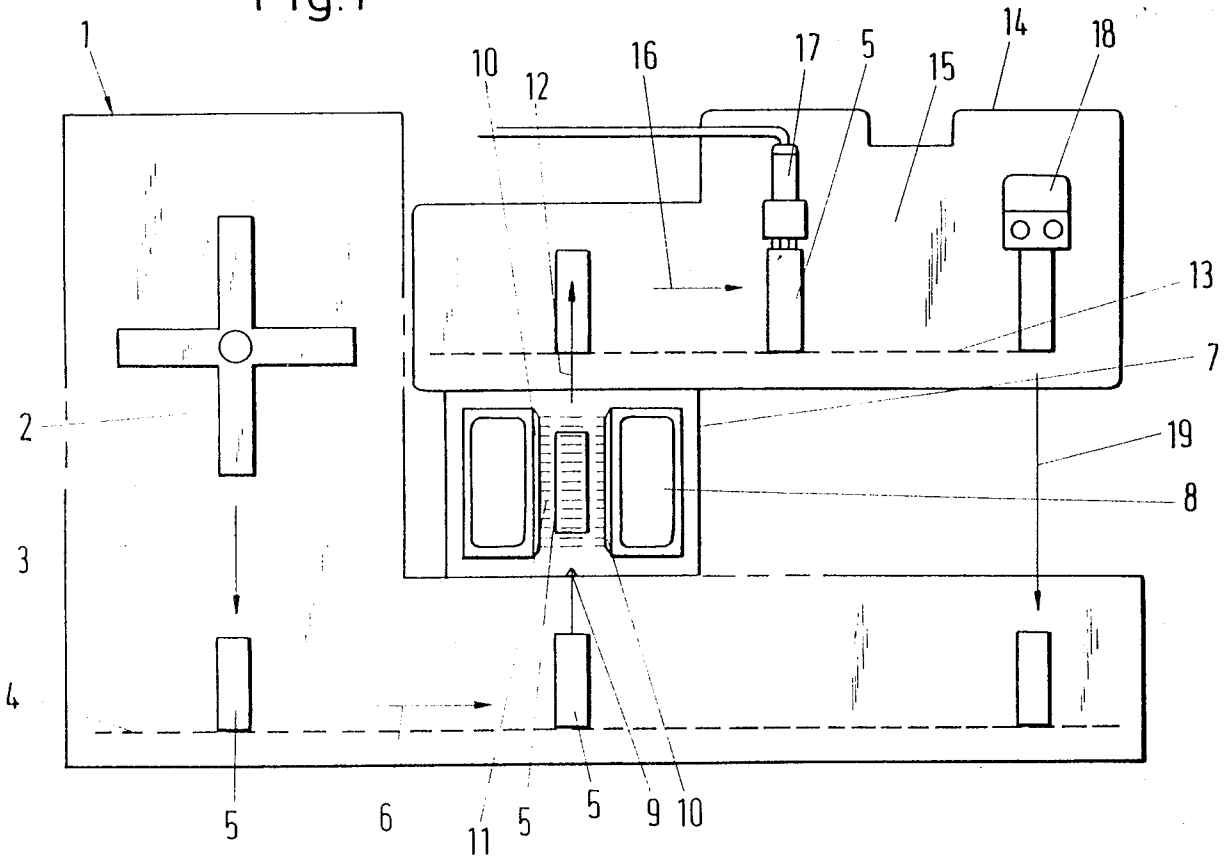

The invention relates to an apparatus for the sterile packaging of flowable substances, comprising a first conveyer belt, from one end of which open packages can be passed by an intermediate conveyer means through a sterilising chamber and to a second conveyer belt disposed in a sterile chamber enclosed in a housing, filling means and sealing means being disposed in this sterile chamber while an outlet sluice is disposed in a wall of the housing.

It is known in the art to package flowable substances in a sterile or aseptic manner, e.g. to package so-called long-life or H-milk in packages the side walls of which consist of plastics-coated paper while covers and bottoms are disposed at the end walls. Where the methods generally known in the art are concerned, the package is initially produced in that it is sterilised while open at one end, after which it can be filled and sealed in a sterile chamber, after which it is possibly passed to further processing stations for outer packing or the like.

If the filling, sealing and final making-up of the package is to be carried out in a sterile chamber, then there is always the difficulty that the package has to be sterilized, passed through an inlet sluice into the sterile chamber, processed there and then carried out of the outlet sluice again without losing too much energy, for example due to the sluices or the sterilising process.

It is known to use high temperatures, hydrogen or electron irradiation to sterilise sheets of paper or similar packaging material coated with synthetic plastics and possibly also with aluminium. If electron irradiation is the method chosen, then particular problems arise in terms of disposition in respect of the sterile chamber and the design of the sluices.

Furthermore, market needs have shown that the quantity of packages filled with sterile product, e.g. with sterilized milk, has increased so much that packaging apparatus for H-milk or the like has to be capable of high rates of output so that in a given unit of time, a large number of packages can be filled with these contents in a sterile fashion.

Therefore, the object of the invention is to provide an apparatus of the type mentioned at the outset, for the sterile packaging of flowable substances, which is of simplified design and which provides for more effective sterilisation.

According to the invention, this problem is resolved in that the sterilising chamber is constructed as an inlet sluice. Therefore, no separate inlet sluice is installed as in the case of prior art machines, possibly even between the sterilising chamber and the processing housing, but according to the invention, the chamber is at the same time used as a sluice. Thus, a two-stage production process is created in which the unfilled package still open at one end is first sterilised and is then filled and sealed in a subsequent, second stage in which it is maintained in a sterile condition. Since a sluice is in any case required for the inlet into the sterile chamber which is sealed off by the housing, the sterilising chamber according to the invention is used as a sluice. If, therefore, inlet means are provided between the first conveyor belt and the sterilising chamber, being constructed like a more or less tightly sealing door, closable opening or as a gate which is opened intermittently, the inadequate closure of this gate or inlet means would not have comparably disadvantageous consequences such as those caused by a sluice mounted directly in the housing of the sterile chamber, because the sterilising means would kill any entrained bacteria or the like. Particularly when conveyer means or parts thereof are intended to be passed through sluices together with the product being conveyed, it is impossible to maintain perfect sealing tightness at gates, tunnels or rotary apertures, possibly even rubber sleeves which are used as sluices. The combination of sterilising chamber and inlet sluice alleviates this problem considerably and therefore makes it possible to simplify the packaging apparatus with the additional effect that the sterilisation can be made considerably more effective.

According to the invention, it is particularly expedient if at least one electron beam unit is disposed in the sterilising chamber. It is known to sterilise surfaces by the use of high temperatures, heated steam, hydrogen and electron beams. In conjunction with the problem of the sluices, steam or hydrogen have frequently been used but the measures according to the invention make it possible to use the more satisfactorily controlled electron beam units which operate with less energy losses, their electron generators, in the case of a particularly preferred embodiment of the invention, being designed for 250–300 keV energy. It is indeed sufficient to expose a moving chain of packages to one electron beam unit but it is particularly expedient if two of these units are so disposed one opposite the other that the windows which allow the electron beams through them are disposed opposite each other. In this case, it is expedient to make the arrangement such that according to the invention, the package or packagings which is or are to be irradiated is or are disposed between the two facing windows of the electron beam units, shields being disposed, preferably of lead, at those locations where no packages are being transported, in order to interrupt or reflect the rays. It goes without saying that it is expedient also to provide the housing of the sterile chamber with leaden walls. By virtue of the risk of damage, in fact, the windows of the electron beam units ought not to be aimed directly at each other. Instead, a protective screen should be disposed between them.

According to the invention, it is particularly expedient if the packages are conveyed through the electron beam field in the direction of their main longitudinal axis. In an advantageous further development of the invention, the intermediate conveyer means comprises for the purpose a package support which is adapted to move through the sterilising chamber. This package support can be made especially small and possibly it may be moved by a rod, preferably in a vertical direction, in which case the first conveyer belt is at a lower level while the second conveyer belt is at a higher level.

According to the invention, it has been shown to be particularly advantageous for the sterilising chamber to be a part of the housing enclosing the sterile chamber and for the inlet sluice to comprise a tunnel and at least one movable closure flap. The various types of sluice according to the state of the art have been mentioned hereinabove. Particularly in the case of the vertical direction of conveyance of the package support which is regarded as favourable according to the invention, movable closure flaps can be provided which ensure the best possible closure at the entrance into and even afterwards, during further movement of the package within the housing and the movable parts in the housing which are connected with the package support. Preferably, these closure flaps only open when the package enters and afterwards they return at least partially to the position of closure, whereas possibly one rod continues to move the package support. It will be appreciated that one closure flap might assume this function. It is however expedient to provide a further closure flap either as a support on which the package can rest, or parallel with it, the said further closure flap being preferably coated with or entirely made from lead and occluding the housing immediately upon opening of the entrance and intake of the package. In consequence, despite the fact that electron beam units are disposed immediately alongside the sluice opening, protective means ensure that when the electron beam units are switched on, no undesired rays emerge to the outside. The initially opened first closure flap then remains in the open position.

It is preferable to provide a tunnel, the inlet aperture of which is sealed by a leaden plate which moves together with the support and no later than after the open package has completed its entrance.

Possibly, this tunnel may also comprise, as a means of inlet from the outside ambient and into the inlet sluice, also the above-described closure flap which, for example as the package with the support moves outwards, so that the leaden plate is lifted off the aperture, ensures that this aperture is closed. By means of such a closure flap or by other means, the sluice with its tunnel can also then be maintained closed when the package is disposed on the lower first conveyer belt. Then, in fact, the leakage of sterile air which seeks to escape from the sterilising chamber into the outside ambient due to the above-atmospheric pressure can be reduced.

This slight over-pressure in terms of sterile air in the chamber is useful in order to prevent bacteria-contaminated air from the outside environment penetrating the sterilising chamber. This sterile air is obtained for example by filtration through a sterile filter. The said closure flaps or similar means then advantageously maintain with limits the loss of continually escaping sterile air.

It is furthermore expedient if the packaging apparatus comprises means of rotating the packages about their longitudinal axis and into a diagonal position. All manner of packagings for contents, e.g. for milk, are known. There are tetrahedral, cuboid or parallelepiped or even to a certain extend tubular packagings. Also, some packagings are already to be found on the market which have a square cross-section but a rectangular longitudinal section. The body of such a package therefore comprises substantially flat side walls separated from one another by four edges. If such a package is conveyed in a longitudinal direction past the window of an electron beam unit, then only that surface which is opposite the window of the beam unit is irradiated, However, the package manufacturer or the packaging company wishes as far as possible to expose all the surfaces of the package to the radiation so that when it leaves the sterilising chamber, it is perfectly and universally sterilised.

For this reason, the so-called diagonal position is assumed according to the invention. This is a position in which, in the case of a cross-sectionally rectangular package, one edge of the side walls is in each case towards the window of the electron beam unit. In this way, as the package passes the irradiating unit, both the surfaces disposed alongside this edge and visible in the projection from the beam unit will be irradiated and thus sterilised. In order to achieve this diagonal position, the aforementioned means of turning the package are provided. The longitudinal axis of the package in the above-described example of embodiment could be that axis of the package in which the package is conveyed from the first conveyer belt through the sterilising chamber or sluice and onto the second conveyor belt, preferably in a vertical direction. A tube-shaped elongated package would therefore stand upright on the package support so that its longitudinal direction, for example the longitudinal central axis, would be in a vertical position.

The said means of turning the packages can be provided in front of or on the first conveyer belt, in any case prior to entering the inlet sluice, so that the package in the diagonal position is passed through the inlet sluice, i.e. through the sterilising chamber and past the irradiating units. The package can then remain in this turned position in the housing enclosing the sterile chamber. However, also further rotating means may be provided in order to turn the package back again and to convey it onwards in the so-called "straight" position.

According to the invention, the conveyer belts and/or the intermediate conveyer means may according to the invention also be constructed as multiple conveyer means. This means that the package support receives a plurality of packages at the same time and therefore a plurality of packages will be simultaneously conveyed past the electron beam unit or units. The—in the case of favourable electron beam units—elongated windows could then, if the intermediate conveyer means have a vertical direction of conveyance, be horizontally aligned to provide a wide field of radiation through which a plurality of packages could be conveyed simultaneously.

In order to achieve simultaneous irradiation of all the surfaces of the package by the beam units, naturally also the beam unit can be obliquely positioned. All that is important is that the package be passed through a field of oblique radiation so that after the package has been passed through the field, all the surface have been irradiated and thus sterilised.

In such a case, it is expedient if, according to the invention, at least one electron beam unit is disposed to emit its radiation at an angle of about 45° to the direction of conveyance of the packages. In this respect, there are for each beam unit four conceivable positions if one plane is arranged through the direction of conveyance of the packages, or if it is intended to use two electron beam units, then on either side of this imaginary plane through the direction of conveyance, there are two conceivable positions for the respective electron beam unit, namely always the position in which the direction of radiation is at an angle of 45° to the direction of feed of the packages or the surface of the package.

Figure 2:
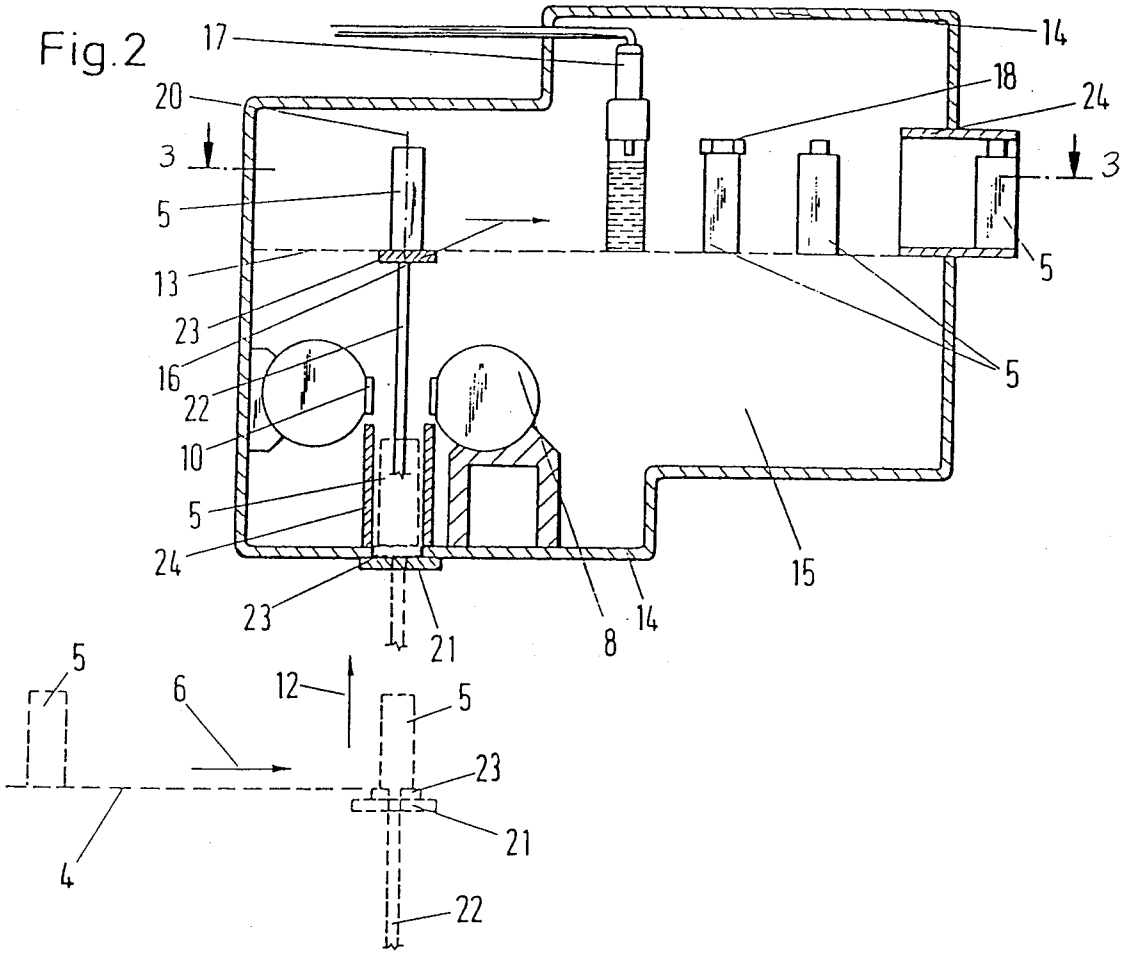
Figure 3:
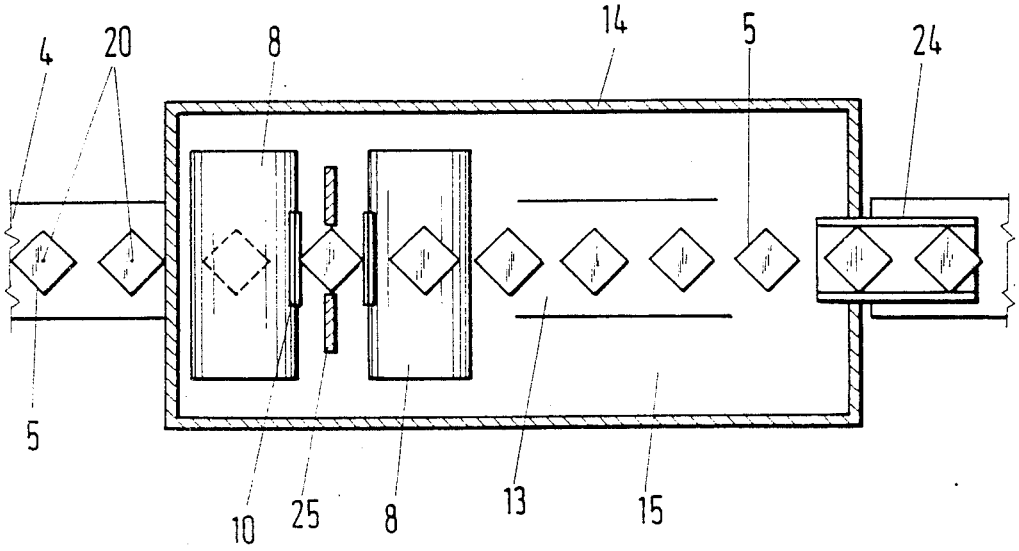
Figure 4:
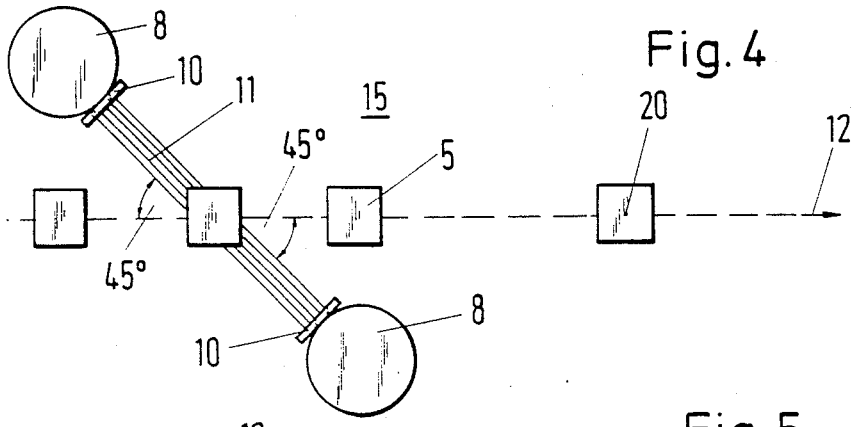
Figure 5:
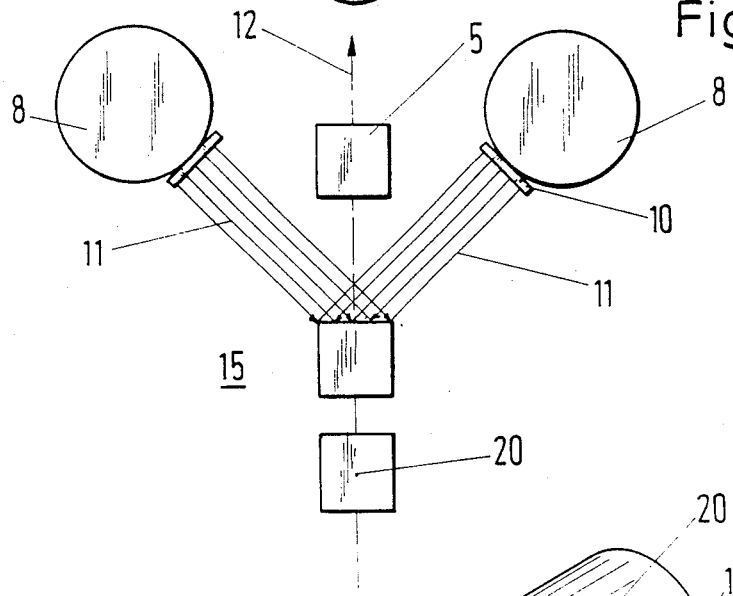
Figure 6:
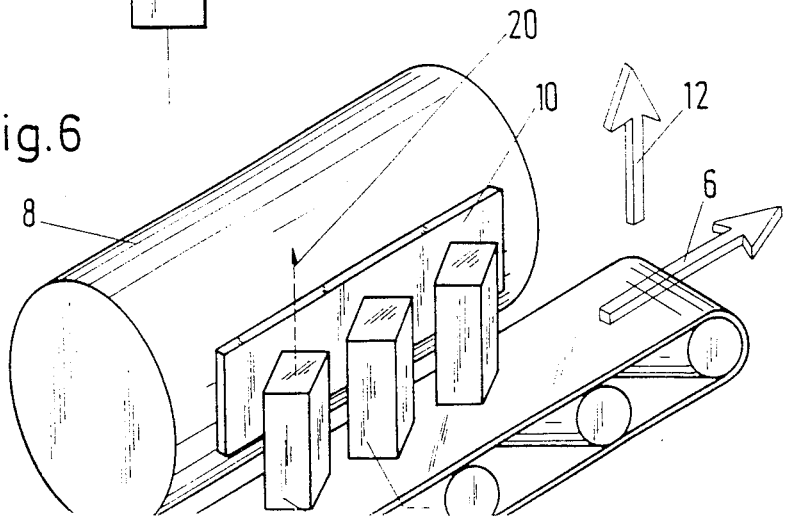

Further advantages, features and possible applications of the present invention will emerge from the ensuing description of preferred examples of embodiment in conjunction with the appended drawings, in which:

FIG. 1 diagrammatically shows the overall apparatus for producing a package and filling it under aseptic conditions, FIG. 2 likewise and still diagrammatically shows a somewhat modified embodiment with horizontally disposed electron beam units, FIG. 3 is a sectional view taken substantially on the line III—III in FIG. 2, FIG. 4 diagrammatically shows the disposition of two electron beam units on opposite sides of the moving chain of packages disposed on a conveyer belt, when the angle between the radiation and the direction of conveyance is 45°, FIG. 5 is a view similar to that in FIG. 4, but with the second beam unit rotated through 90° in relation to the first and FIG. 6 is a broken away and perspective view of the multiple conveyance and multiple irradiation of packages which are to be sterilised.

FIG. 1 diagrammatically shows the package production machine generally designated 1, in which packages not shown are taken from a 'revolving-door' sluice 2 in the direction of the arrow 3 and are placed on a first bottom conveyer belt 4, as shown in the case of the package 5. This is conveyed by the first conveyer belt 4 in the direction 6 of feed thereof into the midway position of the package 5 shown in FIG. 1, below the sterilising chamber 7 which is at the same time constructed as an inlet sluice 8, 9. In this case, 9 is the place at which the package 5 passes through into the sterilising chamber 7 while 8 denotes the two electron beam units which in the present case are so disposed diametrically opposite each other and upright, that their elongated windows 10, extending vertically upwards, generate the radiation field 11 shown by the broken lines in the centre of which is disposed the package 5, being in the process of vertical conveyance as indicated by arrow 12 upwardly onto the second conveyer belt 13.

This second conveyer belt is contained in a sterile chamber 15 enclosed by a housing 14 having leaden walls. Once the package 5 has been placed on the second conveyer belt 13, this latter is moved in the direction of the arrow 16 rightwardly into the midway position under the filling station 17 where the package 5, open at one end, is filled with contents. Subsequently, further conveyance takes place in the direction of the arrow 16 into the position shown on the right in FIG. 1, under the sealing station 18. Thence, the package 5 is moved in the direction of the arrow 19 vertically out of the sterile chamber 15 and back onto the first conveyer belt 4, so that the unsterile package open at one end which was delivered to this belt from the left is now at the right hand end, under the arrow 19, where it is sterilised, filled and sealed.

It can be seen how the sterilising chamber 7 is constructed as an inlet sluice 8, 9 because even with negligible leaks at the passage 9 through from the non-sterile exterior into the sterilising chamber 7, bacteria will be eliminated by the electron beam field 11 from the two radiation units 8. Thus, the sluice function is complete and the packages which, as indicated by the arrow 12, are passed upwards onto the higher second conveyer belt 13, are open at one end and are completely sterilised.

The sterile chamber 15 is preferably maintained sterile in that a slight over-pressure is maintained in the for example sterile filtered air which serves as the sterile medium.

A somewhat modified and particularly preferred embodiment of the packaging apparatus is shown in FIGS. 2 and 3. While here the 'revolving-door' sluice 2 shown in FIG. 1 has been omitted from the non-sterile packaging machine 1, there is still shown the first conveyer belt 4 which is at the lower level and which carries the tube-shaped upright packages 5, of which the longitudinal central axis 20 is vertical. From the position shown on the left in broken lines in FIG. 2, the package 5 is conveyed in the direction 6 into the position which is likewise shown in broken lines but on the right in the drawing, where it is placed on a package support 23 which is fixed on a lifting rod 22. This rod 22 is adapted to be moved with a sliding action and against friction through a closure flap 21 which consists of lead and which, as the package 5 is raised from the position shown in broken lines at the bottom of FIG. 2 into the position shown by solid lines at the top by means of the rod 22 which is moved vertically upwardly according to the arrow 12 until it comes flush with the bottom wall of the housing 14. This closure flap 21 in fact shuts off the bottom of the resultant opening in the housing 14.

This opening in the bottom wall of the housing 14, which can be closed by the closure flap 21, is the bottom open end of a tunnel 24 at which, close to the wall 14, there may possibly be mounted one or two rotatably disposed further closure flaps, not shown, for also closing off the chamber 15 when the flap 21 is pulled off downwardly and the electron beam units are switched off.

When the leaden closure flap 21 is therefore bearing against the bottom wall of the housing 14, as shown by the solid lines in FIG. 2, the package 5 shown in broken lines in this position can be moved farther upwardly together with its support 23 and the lifting rod 22, onto the second conveyer 13. This upper position is shown by solid lines in FIG. 2.

Virtually at the moment when the top edge of the package 5 which is shown by the broken lines in the bottom part of the housing 14 in FIG. 2, has moved past the window 10 of the electron beam units 8, these units are switched on so that during the onwards and upwards travel, the entire package 5 becomes sterilised. Therefore, the electron beams are not only emitted when one or a plurality of packages is or are disposed between the mutually facing windows 10 of the electron beam units 8. Afterwards, these irradiating units are switched off to avoid mutual damage.

After being sterilised, the package 5 is now therefore in the high position shown by the solid lines in FIG. 2, is open at one end and is standing on the upper conveyer belt 13. As in the case of FIG. 1, the package is now moved rightwardly in the direction of the arrow 16 to a position underneath the filling station 17 after which it is conveyed farther onwards to a position under the sealing station 18 so that after it has been filled and sealed, it can leave the sterile chamber 15 through the outlet sluice 24.

From the view in FIG. 3, in conjunction with FIG. 2, it can be seen that the two diametrically opposed electron beam units 8 have their elongated radiation windows 10 horizontally disposed. Nevertheless, according to FIG. 3, with this embodiment only one package 5 after the other is passed vertically through the irradiation field for sterilisation. Since the two irradiating units 8 ought not to direct their rays at each other, a leaden screen 25 is disposed beside the space for the package 5.

The outlet sluice 24 could indeed be a per se known revolving-door type of arrangement, as found at the entrance to fairly large buildings, but in this case it is preferable (as the packages 5 are positioned diagonally) to have a cuboid space which is closed by the actual packages as they pass through it. A revolving-door sluice, as it rotates, will in fact always tend to draw non-sterile air in from outside so that sterilising problems can occur. In the present case, there is only a tiny slit between the package and the wall of the outlet sluice 24 which is however so small that any leakage losses through it are minimal.

FIG. 3 shows the diagonal position of the packages open at one end, so that each of the two oppositely disposed electron beam units 8 can fully irradiate two of the four side walls.

This complete irradiation of two sides of the package body by an electron beam unit 8 is shown clearly in FIGS. 4 and 5. Both drawings show the chain of packages 5 and their direction 12 of conveyance. If an imaginary line is drawn through the direction of conveyance 12 on the one hand and the longitudinal direction or longitudinal central axis 20 of the package 5 on the other, then the radiation 11 from each electron beam unit 8 is at an angle of 45° to this line. Of course, this angle can also be between 40° and 50° and in fact, if an angle of incidence of the rays 11 is in the region of 25° to 70°, satisfactory sterilisation will still result. The packages can then be conveyed "straight".

The situation is the same in the embodiment according to FIG. 5, except that here one of the electron beam units 8 is, in relation to the plane drawn through the lines 12 and 20, on the same side of the package which is about to be irradiated. In the view shown in FIG. 5, it is the front face of the package 5 which is being conveyed "straight" in the direction of the arrow 12 which is being irradiated; a little later, the right hand unit will irradiate the right hand side wall and the left hand unit will simultaneously irradiate the left hand side wall.

Finally, FIG. 6 shows diagrammatically and in perspective the multiple irradiation of packages 5 by the electron beam unit 8 through the irradiation window 10 which is positioned horizontally in the direction of the arrow 6. Three or more packages 5 are therefore conveyed in the direction of the arrow 6 into a bottom position, being then pushed by a package support 23 constructed in this case as a partial conveyer belt, in the direction of the arrow 12 to a place in front of the irradiation window 10, after which the package is then moved on in the manner described above. It will be understood that a more closely adjacent arrangement of the packages 5 is advantageous but is not shown here in order to simplify the drawings.

The movement of the lifting rod 22 can for the rest be otherwise than linear in order to impart a different dose of irradiation to different parts of the package. For example, the bottom portion which is virtually parallel with the electron beams, is subjected to the radiation for a longer period than the rest of the container. An appropriate control arrangement for the non-linear movement of the lifting rod 22 is obtainable commercially if required by a man skilled in the art.

We claim:

1. An apparatus for sterile packaging, which comprises in combination an inlet sluice with irradiating means for sterilizing performed empty containers, said inlet sluice being in the form of a tunnel, means for filling sterile empty containers, and means for sealing filled sterile containers, said inlet sluice with irradiating means for sterilizing empty containers, means for filling sterile empty containers and means for sealing filled sterile containers being located in the interior of a common sterile enclosure, said apparatus including conveying means for elevating the empty containers through said tunnel and delivering to said irradiating means and sterile enclosure, and conveying means for carrying filled sealed containers from said sterile enclosure.

2. The apparatus of claim 1 wherein said irradiating means comprises means for generating a beam of electrons.

3. The apparatus of claim 1 wherein the conveyer means for elevating containers through said tunnel includes closure flap means for protective sealing of said inlet and tunnel against discharge of rays from said sterilizing means.

4. The apparatus of claim 3 including means for maintaining an internal atmospheric pressure which exceeds external atmospheric pressure.

5. The apparatus of claim 2 including means for rotating the containers about their longitudinal axes for maximizing exposure of container surfaces to said electron beam.

6. The apparatus of claim 2 including means for positioning the containers so they are oblique to the irradiating beam of electrons.

7. The apparatus of claim 2 which includes at least one electron beam unit positioned to emit radiation at an angle of approximately 45° to the direction of conveyance of said containers.

* * * * *